US005743387A

United States Patent [19]

Hung

[11] Patent Number: 5,743,387

[45] Date of Patent: Apr. 28, 1998

[54] MULTISTAGE SWITCH

[75] Inventor: Chi-hsiang Hung, Taipei, Taiwan

[73] Assignee: Chin-huei Chiu, Taipei, Taiwan

[21] Appl. No.: 791,090

[22] Filed: Jan. 29, 1997

[51] Int. Cl.[6] ..... H01H 19/20

[52] U.S. Cl. ..... 200/571; 200/570

[58] Field of Search ..... 200/571, 570, 200/568, 564, 565, 336, 526, 523

[56] References Cited

U.S. PATENT DOCUMENTS

| | | | |
|---|---|---|---|
| 3,359,393 | 12/1967 | Anthony | 200/571 |
| 5,586,645 | 12/1996 | Bartok | 200/526 |
| 5,595,290 | 1/1997 | Hsieh | 200/571 |

*Primary Examiner*—David J. Walczak
*Attorney, Agent, or Firm*—Holland & Hart LLP

[57] ABSTRACT

An improved multistage switch with a small size, convenience in assembly and excellent sensitivity. The multistage switch includes a pedestal and a cover engaged with the pedestal. The pedestal defines a central recess therein and has a boss extending upwardly from a base defining the central recess. An input conductive strip, an output conductive strip and a central conductive strip are respectively disposed within the central recess of the pedestal. An input wire connected with the input conductive strip and an output wire connected with the output conductive strip are respectively received within a pair of channels defined in the pedestal. A diode is received within a cavity defined in the pedestal and connected between the input conductive strip and the central conductive strip. A star wheel combined with a conductive base is rotatably mounted on the boss. The star wheel has six ratchet teeth extending from an outer periphery thereof and the conductive base has four contact pieces abutting the six ratchet teeth and contacting with the input conductive strip, the output conductive strip and the central conductive strip. The cover has a knob mounted thereon. The knob has a driving piece mounted therein to drive the star wheel and a spring to control the driving piece.

5 Claims, 6 Drawing Sheets

MULTISTAGE SWITCH

BACKGROUND OF THE INVENTION

1. Field of the Invention

The present invention relates to an improved multistage switch, and more particularly to an improved multistage switch which is small in size, and is convenient to assemble and has excellent sensitivity.

2. Description of Related Art

A conventional multistage switch generally has a structure as shown in FIG. 7. The conventional switch includes a pedestal 90 with a boss 91. A conductive collar 910 is mounted on the boss 91. The conductive collar 910 is divided into four parts and has three contact pieces respectively extending from an outer periphery of three of the four parts. The pedestal 90 further has a first, a second and a third conductive strips 92, 93, 94 disposed therein to abut the conductive collar 910. A first wire 920 connected with the first conductive strip 92 acts as an input of the switch. A second wire 930 and a third wire 940 respectively connected with the second and third conductive strips 93, 94 act as two outputs of the switch and extend from the pedestal 90 to be coupled to a load (not shown) via a diode 95 which is provided for reducing voltage. Since the diode 95 is connected at an outside point of the pedestal 90, it is inconvenient for assembling and also increases the overall size of the switch. Furthermore, when the switch is mounted at a terminal of a luminaire, it is required that the wires 92, 93, 94 extend in a single direction. This needs some of the wires to be sharply curved and may cause a breakdown due to the heat generation of the wires at their breakpoints.

The present invention provides an improved multistage switch to mitigate and/or obviate the aforementioned problems.

SUMMARY OF THE INVENTION

One object of the present invention is to provide an improved multistage switch with a small size and a convenience in assembling.

Another object of the present invention is to provide an improved multistage switch with an excellent sensitivity.

In accordance with one aspect of the present invention, an improved multistage switch includes a pedestal. The pedestal defines a central recess therein, a cavity at a first end thereof, a pair of opposed channels leading to outside and defined at a second end thereof and a pair of holes at an appropriate position thereof. The pedestal further has a boss extending upwardly from a bottom face defining the central recess. An input conductive strip, an output conductive strip and a central conductive strip are respectively disposed within the central recess of the pedestal. An input wire connected with the input conductive strip and an output wire connected with the output conductive strip are respectively received within the pair of channels of the pedestal. A diode is received within the cavity of the pedestal and connected between the input conductive strip and the central conductive strip. A star wheel is rotatably mounted on the boss. The star wheel has a plurality of ratchet teeth extending from an outer periphery thereof. A conductive base is mounted on the boss for receiving the star wheel. The conductive base has a plurality of contact pieces respectively abutting an outer face of a corresponding onr of the ratchet teeth of the star wheel and contacting with the input conductive strip, the output conductive strip and the central conductive strip. A cover defines a pair of holes corresponding to the pair of holes of the pedestal for a pair of rivets to extend through the holes and engage the cover with the pedestal. The cover further has a knob mounted thereon. The knob has a driving piece mounted therein to drive the star wheel and a spring to control the driving piece.

In accordance with another aspect of the present invention, the cover further has a pair of tubes extending downwardly from the pair of holes for locating the rivets.

In accordance with a further aspect of the present invention, the star wheel provides six ratchet teeth and the conductive base provides four contact pieces abutting four of the six ratchet teeth.

In accordance with still a further aspect of the present invention, the input conductive strip has a side strip extending therefrom in order to grip a first end of the diode and the central conductive strip defines a notch for receiving a second end of the diode.

Other objects, advantages and novel features of the invention will become more apparent from the following detailed description when taken in conjunction with the accompanying drawings.

DETAILED DESCRIPTION OF PREFERRED EMBODIMENT

Figure 1:
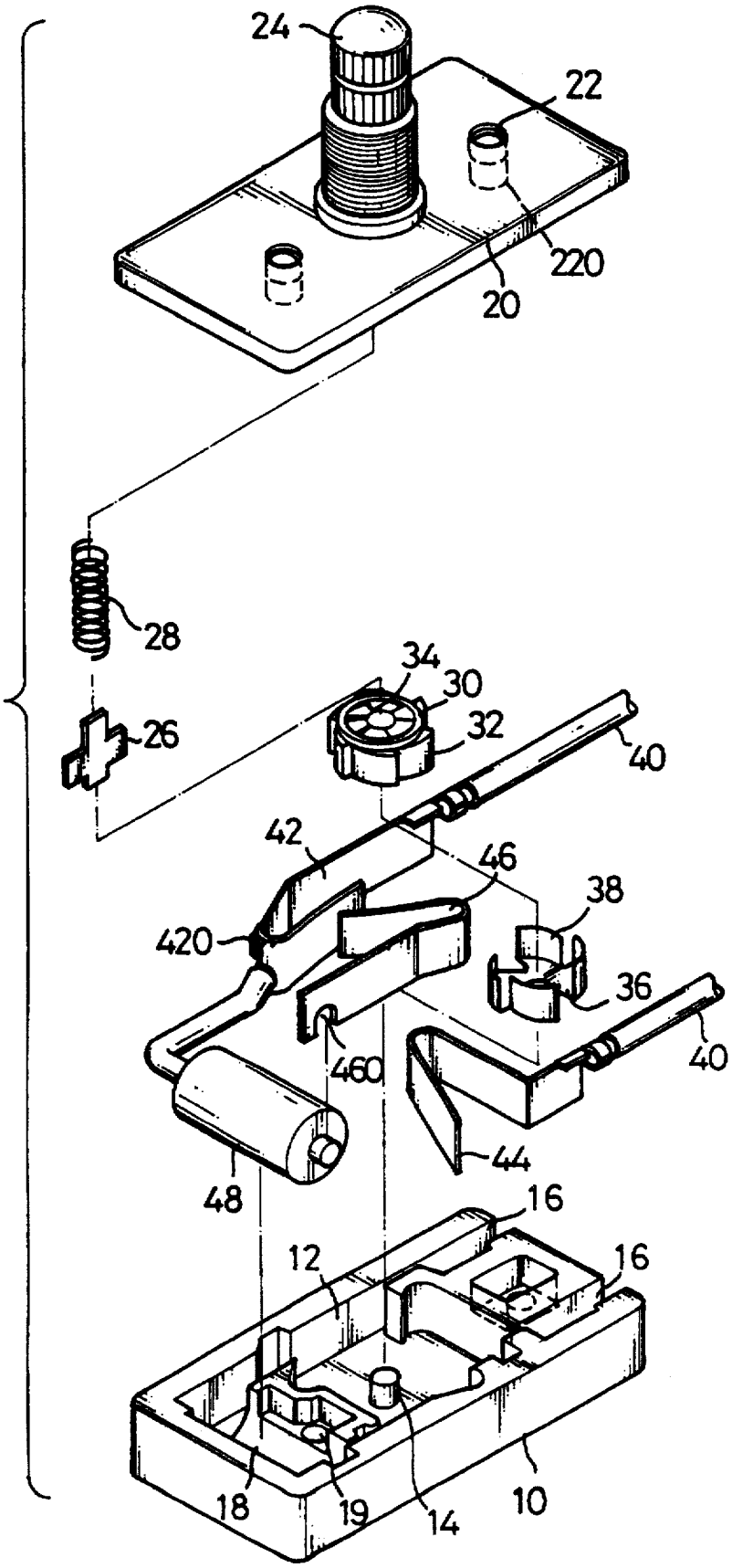
FIG. 1 is an exploded view showing the elements of an improved multistage switch in accordance with a first embodiment of the present invention.

Referring to FIG. 1, an improved multistage switch in accordance with a first preferred embodiment of this invention includes a substantially rectangular pedestal 10. The pedestal 10 defines a central recess 12 and has a boss 14 extending upwardly from a bottom face of the central recess 12. A first end of the pedestal 10 defines a cavity 18 communicating with the central recess 12 and second end of the pedestal 10 defines a pair of opposed channels 16 extending from the central recess 12 to an outside. The pedestal 10 further defines a pair of holes 19 at an appropriate posit on thereof.

An input conductive strip 42, an output conductive strip 44 and a central conductive strip 46 are respectively disposed within the central recess 12 of the pedestal 10. An input wire 40 connected with th input conductive strip 42 and an output wire 40 connected with the output conductive strip 44 are respectively received within the pair of channels 16 of the pedestal 10. A diode 48 is disposed within the cavity 18 of the pedestal 10 and connected between the input conductive strip 42 and the central conductive strip 46. The input conductive strip 42 has a side strip 420 extending therefrom in order to grip a first end of the diode 48 therebetween. The central conductive strip 46 defines a notch 460 therein in order to receive a second end of the diode 48.

A star wheel 30 combined with a conductive base 36 is rotatably mounted on the boss 14 of the pedestal 10. The star wheel 30 has six symmetrical ratchet teeth 32 extending from an outer periphery thereof and defines a plurality of inclined tooth spaces 34 on a top face thereof. The conductive base 36 receives the star wheel 30 and has four contact pieces 38 respectively abutting an outer face of four corresponding ratchet teeth of the star wheel 30.

A cover 20 configured to mate with the pedestal 10, defines a pair of holes 22 therein aligning with the pair of holes 19 of the pedestal 10 and each of the pair of holes 22 has a tube extending downwardly therefrom such that the cover 20 can be engaged with the pedestal 10 by means of a pair of rivets 50 (with a reference to FIG. 2) extending through the holes 19 and 22. The cover 20 further as a knob 24 mounted thereon. The knob 24 has a spring 28 and a driving piece 26 mounted therein. The driving piece 26 can be inserted into the tooth spaces 34 of the star wheel 30 to shift the star wheel 30 to provide a multistage control effect and the spring 28 is provided to control the driving piece 26.

Figure 2:
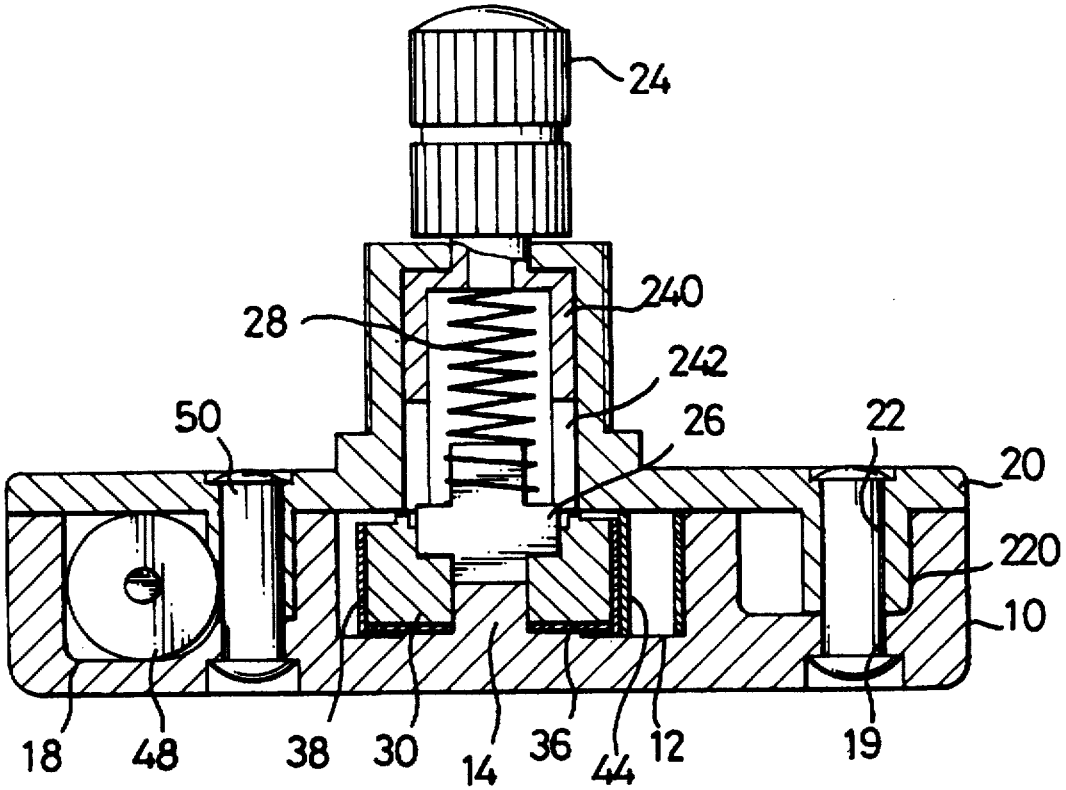
FIG. 2 is a cross-sectional view showing a combined structure of the improved multistage switch of FIG. 1.

Referring to FIG. 2, there is shown a combined structure of the improved multistage switch in accordance with the first embodiment of the present invention. It can be seen that the cover 20 is engaged with the pedestal 10 by the pair of rivets 50. The knob 24 has a sleeve 240 extending integrally and downwardly therefrom for receiving the spring 28 therein. The sleeve 240 defines a pair of sallies 242 at a lower end thereof for seecurely receiving the driving piece 26 therein. The diode 48 is horizontally received within the cavity 18 of the pedestal 10 so that a thickness of the pedestal 10 compared to a prior one can be a minimum.

Figure 3:
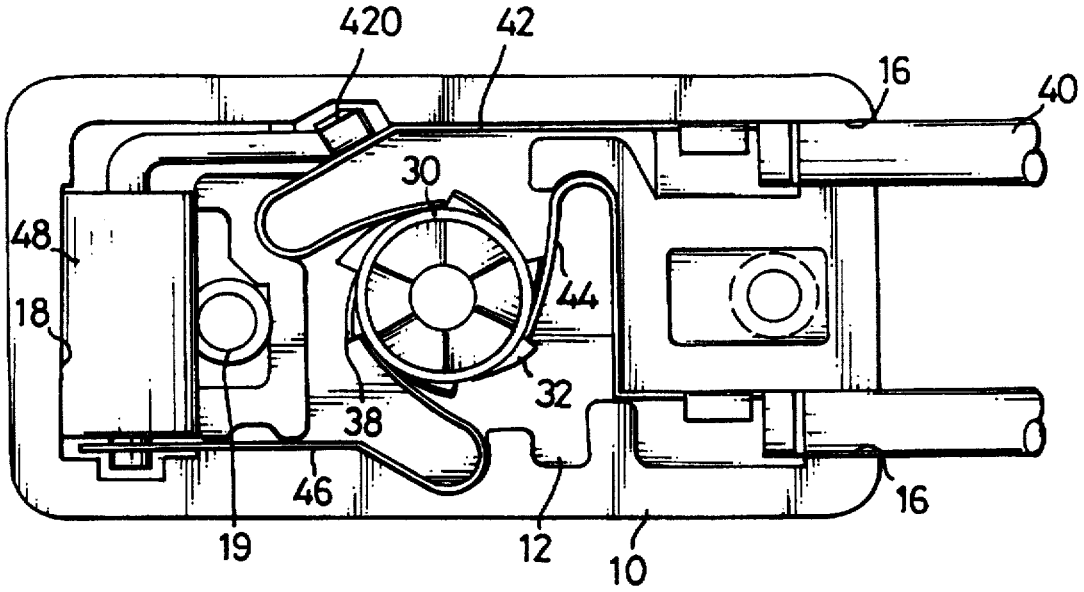
FIG. 3 is a partial top view showing a structure of a pedestal of the improved multistage switch of this invention.
Figure 4:
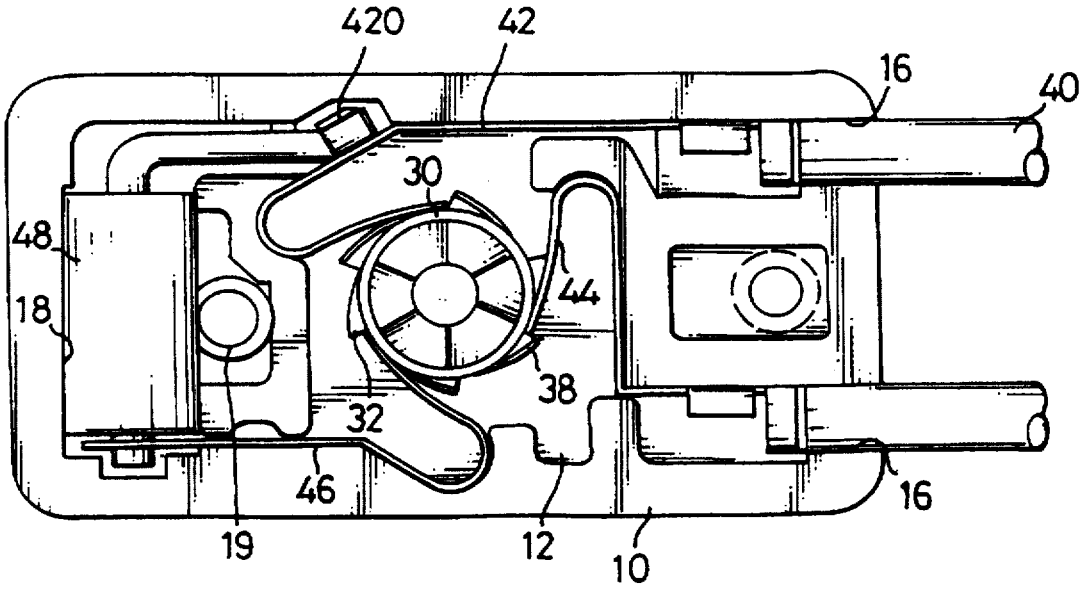
FIG. 4 is a partial top view showing an operation of a star wheel in the pedestal of FIG. 3.

Referring to FIG. 3 and FIG. 4, there are shown an inner structure and operation of the pedestal 10 of the improved multistage switch in accordance with the first embodiment of the present invention. It can be seen that the input conductive strip 42, the output conductive strip 44 and the central conductive strip 46 are respectively disposed within the central recess 12 of the pedestal 10. The input wire 40 connected with the input conductive strip 42 and the output wire 40 connected with the output conductive strip 44 are respectively received within the pair of channels 16 of th pedestal 10, that is the input and output wires 40 are designed to protrude beyond the pedestal 10 at one side thereof in order to facilitate the selection of the manufacturer. The diode 48 is received within the cavity 18 of the pedestal 10 and connected between the input conductive strip 42 and the central conductive strip 46 so that the requirement of circumscription of the diode 48 as in the conventional art can be avoided. It is also understood that when the star wheel 30 rotates unidirectionally, a sensitivity of the switch is improved, because of the configuration of six ratchet teeth 32 and four corresponding contact pieces 38. For example, in the conventional arts, the star wheel generally has four ratchet teeth and three corresponding contact pieces, therefore each ratchet teeth rotates 90 in a cycle and wherein only three rotations of the ratchet teeth are effective. Another conventional switch provides three ratchet teeth and two corresponding contact pieces. This construction still has a disadvantage that each ratchet tooth require to rotate 120° in one cycle. Therefore, each contact piece may suffer from a considerable flexural fatigue. In contrast, the present invention providing six ratchet teeth and four corresponding contact pieces may reduce the flexural fatigue of the contact pieces and make the star wheel 30 more convenient to be operated.

Figure 5:
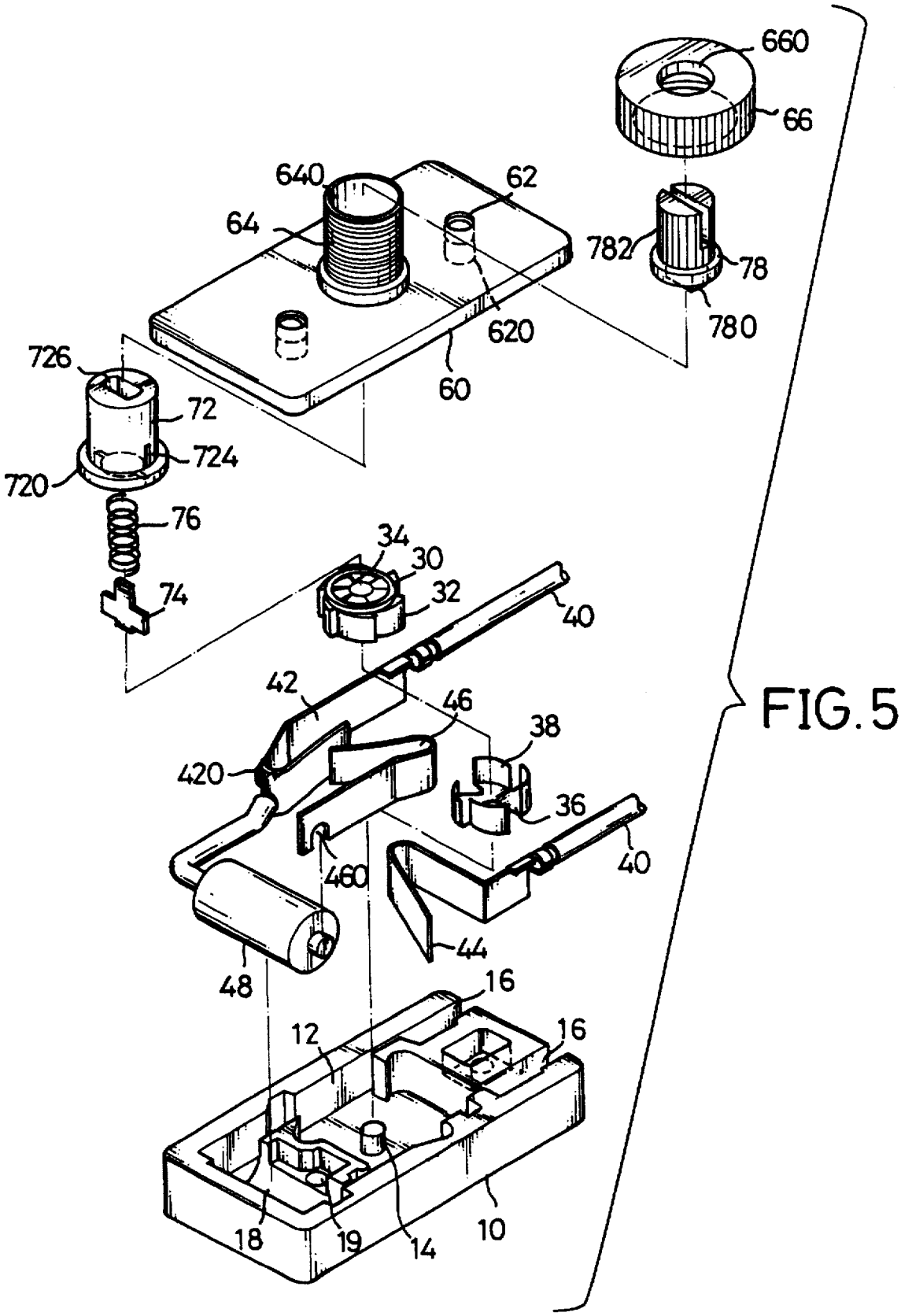
FIG. 5 is an exploded view showing the elements of an improved multistage switch in accordance with a second embodiment of the present invention.
Figure 6:
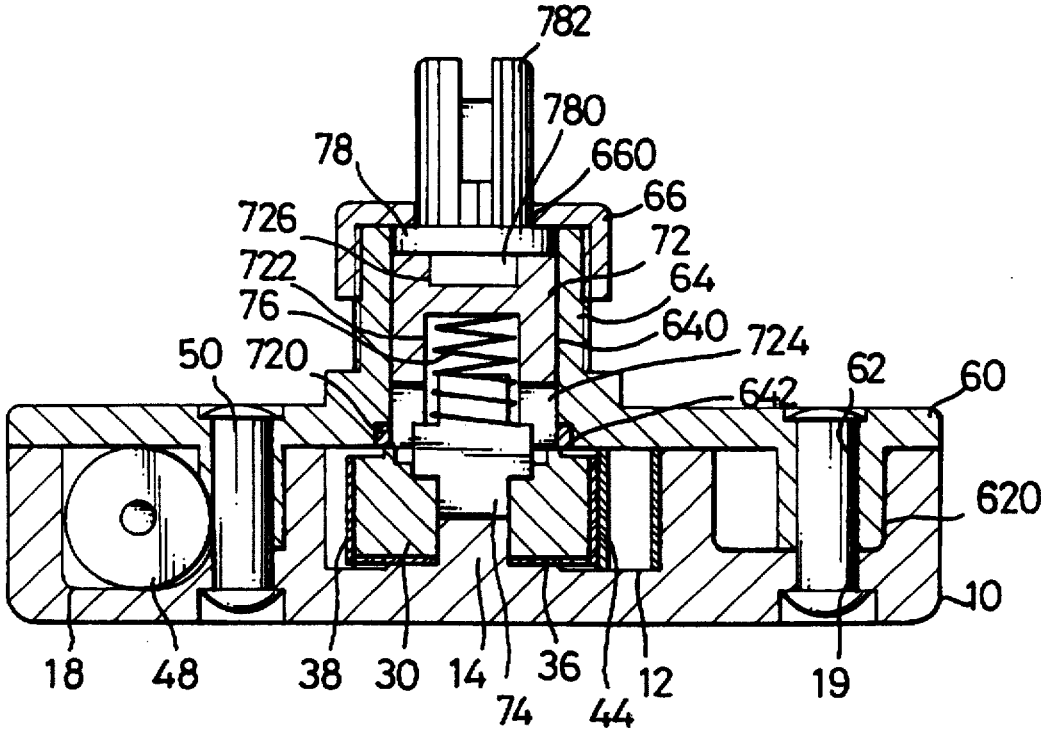
FIG. 6 is a cross-sectional view showing a combined structure of the improved multistage switch of FIG. 5.
Figure 7:
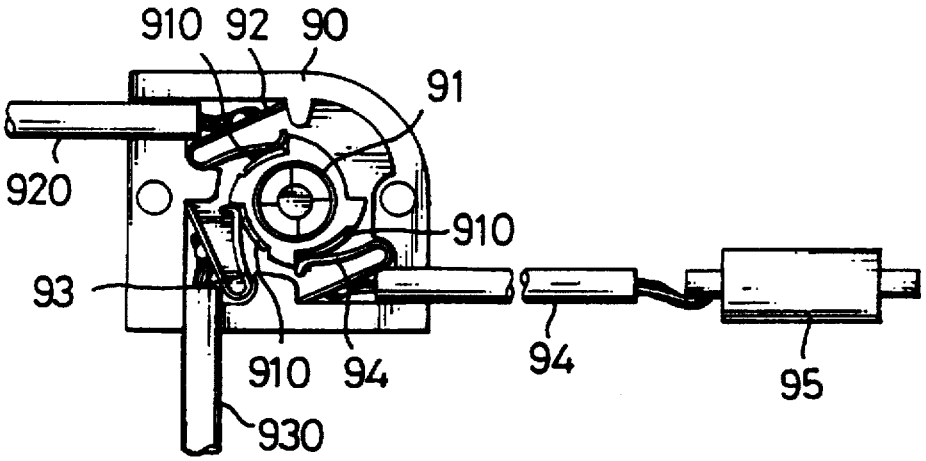
FIG. 7 PRIOR ART
FIG. 7 is top view showing a structure of a conventional multistage switch.

FIGS. 5 and 6 show the elements of an improved multistage switch in accordance with a second embodiment of the present invention. The second embodiment has a pedestal 10 with the same structure as that in the first embodiment. Similarly, a cover 60, which is substantially rectangular to correspond to the pedestal 10, defines a pair of holes 62 corresponding to the pair of holes 19 of the pedestal 10 and each of the pair of holes 62 has a tube 620 extending downwardly therefrom, such that a pair of rivets 50 can extend through the holes 19, 62 to engage the cover 60 with the pedestal 10. The difference is that the cover 60 has a tubular projection 64 mounted thereon. The tubular projection 64 has male thread so that a cap 66 with female thread can be threadedly mounted thereon. The cap 66 defines a central hole 660 therein. The tubular projection 64 further defines a through hole 640 in a longitudinal direction and a counter bore 642 is defined in a bottom periphery thereof (see FIG. 6). An inner knob 72 is received within the through hole 640 of the tubular projection 64. The inner knob 72 is shape as a column and a height of the inner knob 72 is smaller than that of the rest 64. The inner knob 72 has a circumferential flange 720 extending from a lower circumferential periphery thereof and defines a blind hole 722 in a lower end thereof. A pair of sallies 724 intersectingly communicate with the blind hole 722 in a lower portion of a wall thereof to receive a driving piece 74. Similarly, a spring 76 is mounted on the driving piece 74 to provide a control function. The inner knob 72 further defines a recess 726 in an upper end thereof to engage with an outer knob 78. The outer knob 78 has a protrusion 780 extending from a bottom end thereof to be received within the recess 726 of the inner knob 72 and has a button portion 782 at a top end thereof. The button portion 782 extends through the central hole 660 of the cap 66 and defines a grooving (not numbered) therein and a plurality of veins on an outer face thereof in order to be engaged with a casing (not shown).

The operation of the second embodiment is based on the same principle as that of the first embodiment, the inner knob 72 and the outer knob 78 are cooperated to control the driving piece 74 to shift the star wheel 30 disposed in the pedestal 10. Therefore, the second embodiment can obtain the same effect as that in the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed s:

1. An improved multistage switch comprising:

a pedestal defining a central recess therein, a cavity at a first end thereof, a pair of opposed channels at a second end thereof leading to outside and a pair of holes at an appropriate position therein, said pedestal further having a boss extending upwardly from a bottom face of the central recess;

an input conductive strip, an output conductive strip and a central conductive strip respectively disposed within the central recess of the pedestal, an input wire connected with the input conductive strip and an output wire connected with the output conductive strip being respectively received within the pair of channels of the pedestal, a diode received within the cavity of the pedestal and connected between the input conductive strip and the central conductive strip;

a star wheel rotatably mounted on the boss, said star wheel having a plurality of ratchet teeth extending from an outer periphery thereof;

a conductive base mounted on the boss for receiving the star wheel, said conductive base having a plurality of contact pieces respectively abutting an outer face of a corresponding ratch of the star wheel and contacting with the input conductive strip, the output conductive strip and the central conductive strip; and a cover defining a pair of holes corresponding to the pair of holes of the pedestal for a pair of rivets to extend therethrough and engage the cover with the pedestal, said cover having a knob mounted thereon, said knob having a driving piece mounted therein to drive the star wheel and a spring to control the driving piece.

2. An improved multistage switch as claimed in claim 1, wherein said cover further has a pair of tubes extending downwardly from respective peripheries defining the pair of holes for locating the pair of rivets.

3. An improved multistage switch as claimed in claim 1, wherein the star wheel provides six ratchet teeth and the conductive base provides four contact pieces abutting the six ratchet teeth.

4. An improved multistage switch as claimed in claim 1, wherein said input conductive strip has a side strip extending therefrom in order to grip a first end of the diode therebetween.

5. An improved multistage switch as claimed in claim 1, wherein said central conductive strip defines a notch for receiving a second end of the diode.

* * * * *